US007598476B2

(12) United States Patent
Chae et al.

(10) Patent No.: US 7,598,476 B2
(45) Date of Patent: Oct. 6, 2009

(54) IMAGE FORMING APPARATUS HAVING IMPROVED FLICKER CHARACTERISTICS AND METHOD THEREOF

(75) Inventors: Young-Min Chae, Suwon-si (KR); Hwan-Guem Kim, Seoul (KR); Durk-Hyun Cho, Suwon-si (KR); Su-Kyoung Chae, Seoul (KR); Sang-Yong Han, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 680 days.

(21) Appl. No.: 11/299,631

(22) Filed: Dec. 13, 2005

(65) Prior Publication Data

US 2006/0124630 A1 Jun. 15, 2006

(30) Foreign Application Priority Data

Dec. 14, 2004 (KR) ..... 10-2004-0105616

(51) Int. Cl.
*H05B 11/00* (2006.01)
*G03G 15/20* (2006.01)

(52) U.S. Cl. ..... 219/216; 219/619; 219/130.21; 219/497; 219/499; 219/501; 219/481; 219/508; 219/505; 399/69; 399/70

(58) Field of Classification Search ..... 219/216, 219/619, 130.21, 497, 499, 501, 481, 508, 219/505; 399/69, 70
See application file for complete search history.

(56) References Cited

U.S. PATENT DOCUMENTS 5,789,723 A * 8/1998 Hirst ..... 219/501
6,240,263 B1 5/2001 Watanabe

FOREIGN PATENT DOCUMENTS

| | | |
|---|---|---|
| JP | 10-010914 | 1/1998 |
| JP | 2002-063981 | 2/2002 |
| JP | 2002-174973 | 6/2002 |
| JP | 2003-151721 | 5/2003 |
| KR | 1991-0005107 | 3/1991 |
| KR | 1998-061631 | 10/1998 |
| KR | 20-00-0040693 | 7/2000 |
| KR | 2002-0063663 | 8/2002 |

* cited by examiner

*Primary Examiner*—Shawntina Fuqua
(74) *Attorney, Agent, or Firm*—Roylance, Abrams, Berdo & Goodman, L.L.P.

(57) ABSTRACT

A fusing apparatus in an image forming apparatus that heats a fusing unit by applying an induced current is provided. The flicker characteristics of the fusing apparatus are improved by gradually increasing the amount of induced current applied to the fusing unit for a predetermined amount of time so that the amount of induced current applied to the fusing unit is prevented from severely varying. The fusing apparatus comprises a fusing unit which is resistance-heated or induction-heated by applying an induced current and fuses toner onto paper using the heat. The fusing apparatus further comprises a pulse width modulation (PWM) signal generation unit which generates a PWM signal in response to the ON signal so that the amount of induced current input to the fusing unit gradually increases to a reference current.

19 Claims, 5 Drawing Sheets

IMAGE FORMING APPARATUS HAVING IMPROVED FLICKER CHARACTERISTICS AND METHOD THEREOF

PRIORITY

This application claims the benefit under 35 U.S.C. § 119 (a) of Korean Patent Application No. 10-2004-0105616, filed on Dec. 14, 2004, in the Korean Intellectual Property Office, the entire disclosure of which is hereby incorporated by reference.

BACKGROUND OF THE INVENTION

1. Field of the Invention

The present invention relates to a fusing apparatus for fusing a toner image onto paper. More particularly, the present invention relates to a fusing apparatus in an image forming apparatus that heats a fusing unit by applying an induced current. Flicker characteristics of the fusing apparatus are improved by gradually increasing the amount of induced current applied to the fusing unit for a predetermined amount of time so that the amount of induced current applied to the fusing unit is prevented from severely varying.

2. Description of the Related Art

A conventional image printing apparatus comprises a fusing apparatus that applies a predetermined pressure and amount of heat to toner in order to fuse the toner image onto paper. The fusing apparatus includes a fusing unit which applies a predetermined amount of heat to the toner and a pressurizer that applies a predetermined pressure to the toner. The fusing unit includes a heating body that generates heat used to fuse the toner image onto the paper and a fusing roller that transfers heat generated by the heating body onto the paper.

FIG. 1 shows a schematic cross-sectional view taken along a lateral plane through a fusing unit 10 of a conventional fusing apparatus using a halogen lamp as a heat source. Referring to FIG. 1, the fusing unit 10 comprises a fusing roller 11 and a heating body 12, which is a halogen lamp, installed in the center of the fusing unit 10. A coating layer 1 la made of Teflon is formed on the surface of the fusing roller 11. The heating body 12 generates heat, and the fusing roller 11 is heated by radiant heat transferred from the heating body 12.

FIG. 2 illustrates a functional block diagram of a conventional fusing apparatus using a halogen lamp as a heat source. Referring to FIG. 2, noise is filtered from the voltage input, power supply voltage 210, by passing the voltage through a line filtering unit 220. The filtered voltage is provided to a heating unit 250 of fusing roller 240. The heating unit 250 is resistance-heated by the filtered voltage input thereto, and heat generated by the heating unit 250 heats the fusing roller 240. The temperature of the fusing roller 240 is sensed by sensing unit 260. A control unit 270 controls the turning on or off of switch 230 with reference to the temperature of the fusing roller 240 sensed by sensing unit 260.

In a conventional fusing unit using a halogen lamp as a heat source, a warm-up time of several seconds to several minutes is required to supply sufficient energy and heat to the fusing roller 11 so that the fusing roller 11 reaches a target fusing temperature. Thus, a user should wait for a long warm-up time when printing an image.

In conventional fusing units, the amount of current flowing in a heating unit is determined by the voltage applied to the heating unit. However, when voltage is applied to the heating unit, the amount of current input to the heating unit drastically increases, thereby causing deteriorating flicker characteristics.

SUMMARY OF THE INVENTION

Aspects of the present invention provide a fusing apparatus in an image forming apparatus for heating a fusing unit using induced current. Flicker characteristics of the fusing apparatus are improved by gradually increasing the amount of induced current input to the fusing unit for a predetermined amount of time.

According to an aspect of the present invention, there is provided a fusing apparatus that fuses toner onto paper. The fusing apparatus comprises a fusing unit which is resistance-heated or induction-heated by an induced current, thereby generating heat and fusing toner onto paper using the heat generated. The fusing apparatus further comprises a sensing unit which senses the temperature of the fusing unit, an on/off signal generation unit which generates an ON/OFF signal for controlling the turning ON or OFF of the fusing unit according to the temperature of the fusing unit, and a pulse width modulation (PWM) signal generation unit which generates a PWM signal in response to the ON signal so that the amount of induced current input to the fusing unit gradually increases to a reference current.

The fusing unit may comprise an alternating current (AC) generation unit which generates an AC current based on the PWM signal, an insulation unit which receives the AC current and generates an induced current corresponding to the AC current, and a toner fusing unit which is resistance-heated or induction-heated by the induced current received from the insulation unit, thereby generating heat and fusing toner onto paper using the heat.

The PWM signal generation unit may comprise a signal generator which generates a PWM signal having a predetermined frequency to generate an induced current to be input to the fusing unit, and a soft starter which controls the frequency of the PWM signal so that the amount of induced current provided to the fusing unit gradually increases to the reference current for a predetermined amount of time.

The PWM signal generation unit may also comprise a comparator which compares the induced current provided to the fusing unit and the reference current. The signal generator controls the frequency of the PWM signal according to the comparison results provided by the comparator.

BRIEF DESCRIPTION OF THE DRAWINGS

The above and other exemplary features and advantages of the present invention will become more apparent by describing in detail certain exemplary embodiments thereof with reference to the accompanying drawings, in which.

Throughout the drawings, like reference numbers should be understood to refer to like elements, features, and structures.

DETAILED DESCRIPTION OF EXEMPLARY EMBODIMENTS

The matters exemplified in this description are provided to assist in a comprehensive understanding of various exemplary embodiments of the present invention disclosed with reference to the accompanying figures. Accordingly, those of ordinary skill in the art will recognize that various changes and modifications of the exemplary embodiments described herein can be made without departing from the scope and spirit of the claimed invention. Descriptions of well-known functions and constructions are omitted for clarity and conciseness.

Figure 1:
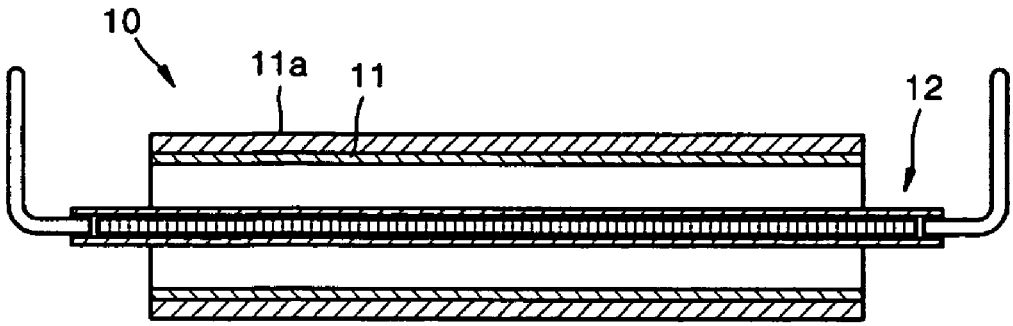
FIG. 1 (PRIOR ART)
FIG. 1 shows a cross-sectional view taken along a lateral plane through a fusing unit of a conventional fusing apparatus using a halogen lamp as a heat source.
Figure 2:
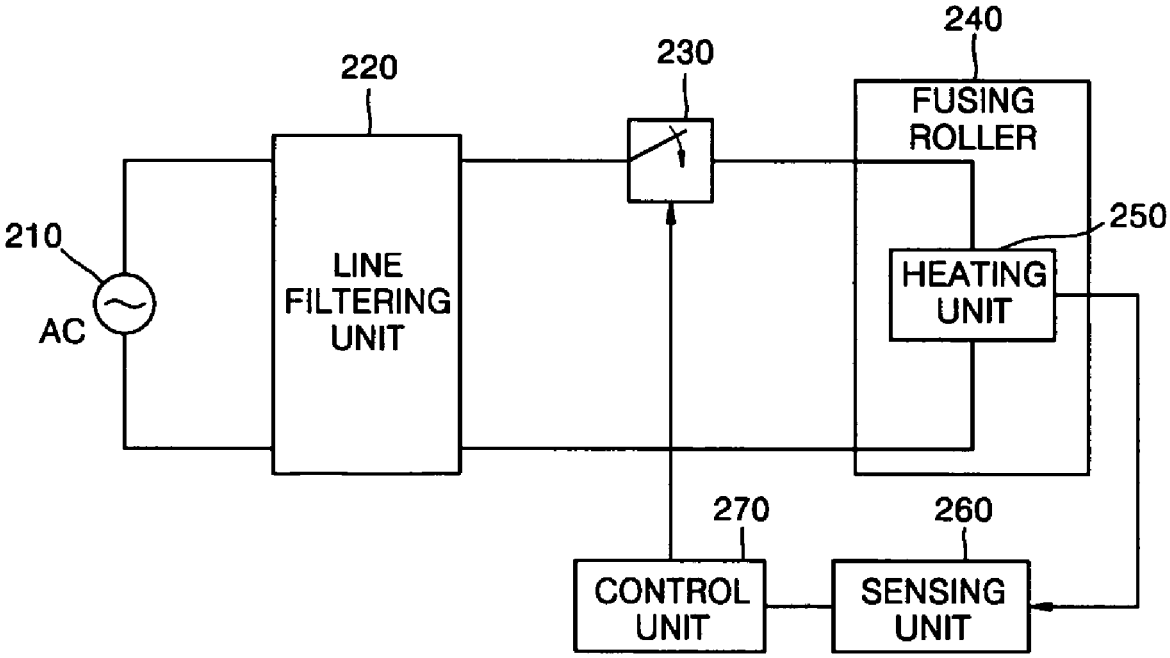
FIG. 2 (PRIOR ART)
FIG. 2 illustrates a functional block diagram of a conventional fusing apparatus that heats a fusing unit thereof.
Figure 3:
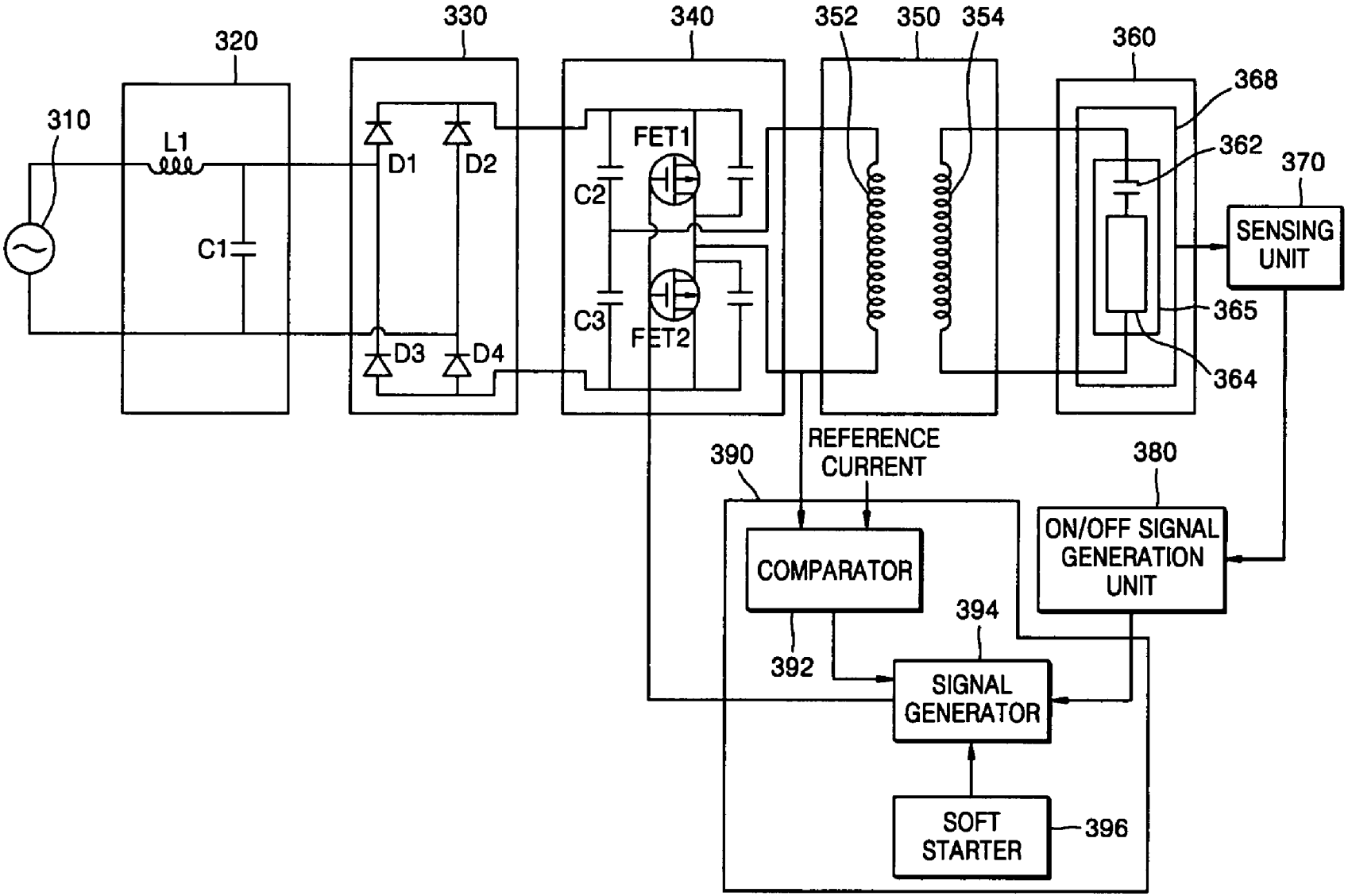
FIG. 3 illustrates a functional block diagram of a fusing apparatus according to an exemplary embodiment of the present invention.

FIG. 3 illustrates a functional block diagram of a fusing apparatus according to an exemplary embodiment of the present invention. Referring to FIG. 3, the fusing apparatus comprises an alternating current (AC) generation unit 340, an insulation unit 350, a fusing unit 360, a sensing unit 370, an ON/OFF signal generation unit 380, and a pulse width modulation (PWM) signal generation unit 390. The-fusing apparatus also comprises a power supply unit 310, which provides current to the AC generation unit 340, a line filtering unit 320, and a rectification unit 330.

The power supply unit 310 provides an AC current with a predetermined intensity and frequency to the line filtering unit 320. The line filtering unit 320 is comprised of an inductor L1 and a capacitor C1 and removes harmonic components from the AC current provided by the power supply unit 310. The line filtering unit 320 is exemplary, and line filtering units other than the line filtering unit 320 may be used without departing from the scope of the present invention.

The rectification unit 330 generates a direct current (DC) current by rectifying the AC current provided by the line filtering unit 320. The rectification unit 330 is exemplary and is shown as a bridge rectifier comprised of 4 diodes D1 through D4 and rectifies AC into DC using the polarities of the 4 diodes D1 through D4. The AC current provided by the line filtering unit 320 can be rectified into DC current using a rectifier other than the rectification unit 330 without departing from the scope of the present invention.

The AC generation unit 340 receives DC current from the rectification unit 330 and generates an AC current with a predetermined frequency based on the received DC current. The AC generation unit 340 is comprised of two capacitors C2 and C3 and two field effect transistors (FETs) FET1 and FET2. The PWM signal generation unit 390 generates a PWM signal. The PWM signal is input to the gates of FET1 and FET2. FET1 and FET2 alternately operate in response to the PWM signal input thereto to generate high-frequency AC current. The AC generation unit 340 may be a half-bridge inverter.

The insulation unit 350 generates an induced current using the AC current generated by the AC generation unit 340. The induced current generated by the insulation unit 350 is provided to the fusing unit 360. The isolation unit 350 may be a transformer, and particularly, a high-frequency transformer that is smaller than a low-frequency transformer.

When an AC current flows into a first coil 352 of isolation unit 350, a magnetic field varies around a second coil 354 of the isolation unit 350. An induced current generated by the isolation unit 350 is provided to a heating unit 365 of the fusing unit 360. The amount of induced current generated by the isolation unit 350 may be controlled by manipulating the turn ratio of first and second coils 352 and 354, respectively. In short, the current flowing into the first coil 352 of the isolation unit 350 generates an induced current in the second coil 354 through electromagnetic induction, and the induced current is provided to the fusing unit 360. Since the induced current generated by the isolation unit 350; instead of the current provided by the power supply unit 310, is provided to the second coil 354, the power supply unit 310 and the fusing unit 360 are electrically isolated from each other.

The fusing unit 360 comprises a fusing roller unit 368 that fuses toner onto paper using heat generated by the heating unit 365, which is resistance-heated or induction-heated by the induced current generated by the isolation unit 350. The heating unit 365 comprises a heating element 364, which is induction-heated or resistance-heated by an induced current input thereto, and a thin insulation layer (not shown), which prevents a short circuit between the heating element 364 and the fusing roller unit 368, and a resonant capacitor 362. The heating element 364 may be a coil having a predetermined inductance and resistance. The inductance of the heating element 364 forms a resonance circuit with the resonance capacitor 362.

The sensing unit 370 senses the temperature of the fusing roller unit 368, generates a sense signal indicating the temperature of the fusing roller unit 368, and forwards the sensing signal to the ON/OFF signal generation unit 380. The ON/OFF signal generation unit 380 generates an ON signal, which is provided to the fusing roller unit 368 if the magnitude of the sense signal becomes lower than a first threshold value TH1. The ON/OFF signal generation unit 380 generates an OFF signal, which is used for cutting off the power supplied to the fusing unit 360 if the magnitude of the sense signal becomes higher than a second threshold value TH2.

The PWM signal generation unit 390 comprises a comparator 392, a signal generator 394, and a soft starter 396. The PWM signal generation unit 390 receives the ON signal from the ON/OFF signal generation unit 380 and generates a PWM signal used for controlling the temperature of the fusing roller unit 368 based on the received on signal.

The signal generator 394 generates a PWM signal having a predetermined frequency to generate an induced current to be provided to the fusing unit 360 and then provides the PWM signal to FET1 and FET2. FET1 and FET2 are alternatively switched to generate an AC current having a predetermined frequency, and an induced current is generated in the isolation unit 350 due to the AC current generated by FET1 and FET2.

The lower the frequency of the PWM signal generated by the PWM signal generation unit 390, the lower the frequency of the AC generated by the AC generation unit 340. The lower the frequency of the AC current generated by the AC generation unit 340, the higher the frequency of the induced current provided to the fusing unit 360. The frequency of the PWM signal generated by the PWM signal generation unit 394 is set so that maximum power can be provided-to the fusing unit 360. The amount of induced current that can provide the maximum power to the fusing unit 360 will hereinafter be referred to as a reference current The soft starter 396 controls the frequency of the PWM signal so that the amount of induced current provided to the fusing unit 360 gradually increases relative to the reference current for a predetermined amount of time. In other words, the soft starter 396 controls the frequency of the PWM signal for the first few cycles to have a gradually decreasing frequency so that the amount of induced current gradually increases. Thereafter, the soft starter 396 controls the frequency of the PWM signal to have a predetermined frequency so that the reference current is generated. For a few cycles, the soft starter 396 can control the frequency of the PWM signal via software by gradually increasing the frequency of the PWM signal whenever each cycle ends. Alternatively, the soft starter 396 can control the frequency of the PWM signal via hardware by gradually increasing the frequency of the PWM signal whenever a predetermined capacitor is completely charged. The frequency of the PWM signal may also be controlled in a manner other than as set forth herein without departing from the scope of the present invention.

The comparator 392 calculates the difference between the amount of induced current provided to the fusing unit 360 and the amount of reference current, and the signal generator 394 controls the frequency of the PWM signal so that the difference between the amount of induced current and the amount of reference current can be compensated for.

A coil of the fusing unit 360 has a low inductance, thus the resonance circuit comprising the capacitor and the inductance of the coil of the fusing unit 360 has a high resonance frequency. The switching frequency of the AC generation unit 340 must be set to be two times higher than the resonance frequency of the resonance circuit.

Figure 4A:
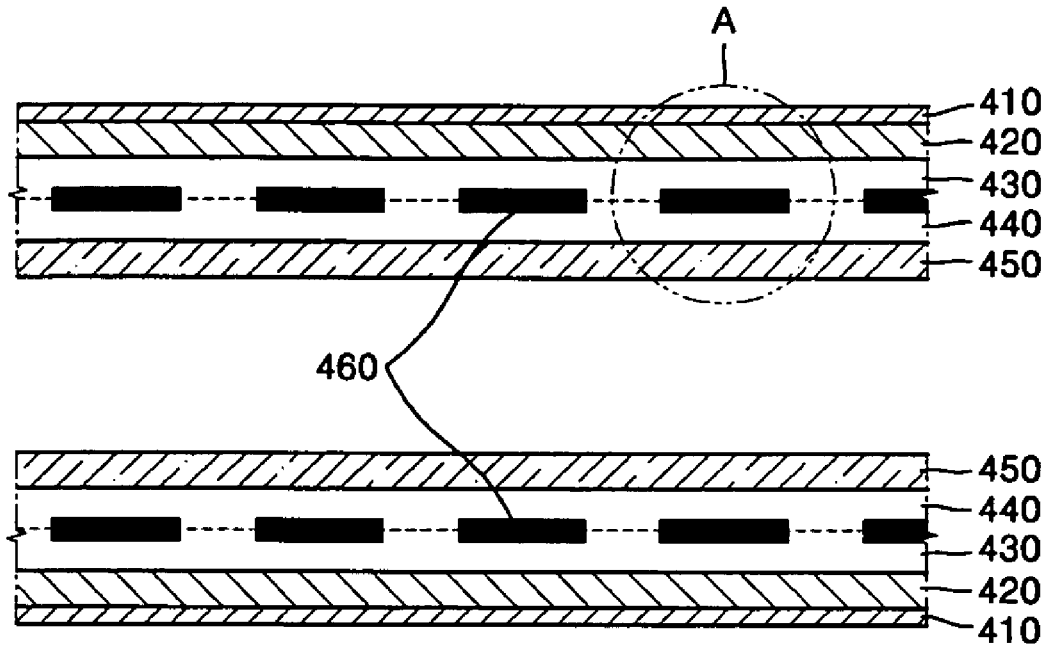
FIGS. 4A and 4B depict diagrams illustrating a fusing unit of the exemplary fusing apparatus of FIG. 3.
Figure 4B:
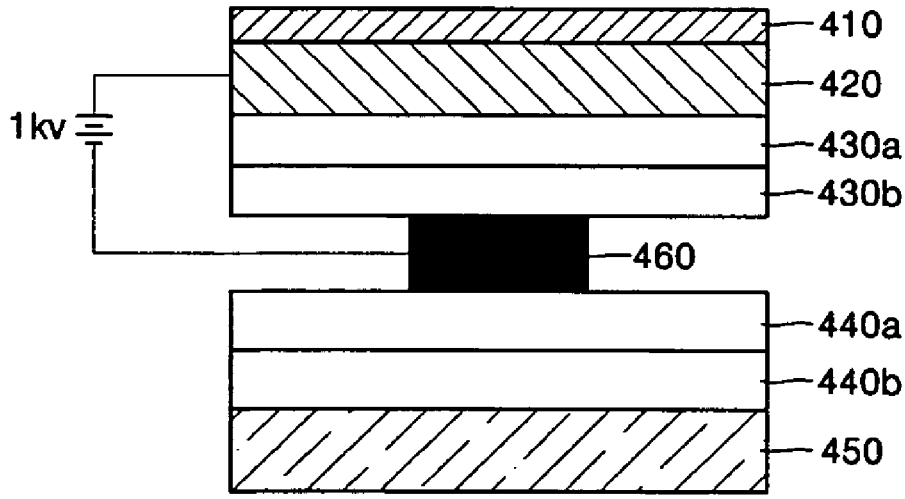

FIGS. 4A and 4B depict diagrams illustrating the fusing unit 360 of the exemplary fusing apparatus of FIG. 3. Specifically, FIG. 4A illustrates a schematic cross-sectional view taken along a lateral plane through the fusing unit 360, and FIG. 4B shows a diagram illustrating the heating unit 365 of the fusing unit 360. Referring to FIG. 4A, the fusing unit 360 comprises a fusing roller portion 420, which is a cylinder on which a protection layer 410 coated with Teflon is formed, a tube-type expansion adhesion portion 450, which is installed inside the fusing roller portion 420, and a heating body 460, which is installed between the fusing roller portion 420 and the tube-type expansion adhesion portion 450. The fusing unit 360 also comprises insulation layers 430 and 440, which are installed to surround the tube-type expansion adhesion portion 450 as swirls and thus insulate the heating body 460 by preventing a short circuit between the heating body 460 between the fusing roller portion 420 and the tube-type expansion adhesion portion 450 when the heating body 460 is heated due to a current applied thereto.

The fusing roller portion 420 is an example of atoner fuser that fuses toner onto paper. However, toner fusers other than the fusing roller portion 420 may be used to fuse toner onto paper without departing from the scope of the present invention.

The heating body 460 may be a coil. In this case, the coil is resistance-heated due to a first induced current generated by the isolation unit 350. The first induced current corresponds to an AC current input to the isolation unit 350. When the first induced current is input to the coil, an alternating magnetic flux that varies in accordance with the first eddy current is generated around the coil. The alternating magnetic flux crosses the fusing roller portion 420, and the fusing roller portion 420 generates a second induced current to counteract the change in the alternating magnetic flux. The fusing roller portion 420 may be formed of alloys such as copper alloy, aluminum alloy, nickel alloy, iron alloy, chrome alloy, or magnesium alloy. The fusing roller portion 420 has electrical resistance and thus is resistance-heated by the second induced current. Hereinafter, the heating of the fusing roller portion 420 using the second induced current will be referred to as induction heating. The fusing roller portion 420 may be formed of a material, other than those set forth herein, without departing from the scope of the present invention.

The heating body 460 may be formed of alloys such as copper alloy, aluminum alloy, nickel alloy, iron alloy, or chrome alloy having a both-end resistance of the heating body 460 equal to or less than 100 Ω so that the heating body 460 is resistance-heated by a resistance loss occurring when a current is input thereto. The heating body 460 may be formed of a material, other than those set forth herein, without departing from the scope of the present invention.

The insulation layers 430 and 440 comprise a first insulation layer 430 interposed between the fusing roller portion 420 and the heating body 460 and a second insulation layer 440 interposed between the heating body 460 and the tube-expansion adhesion unit 450. The first and second insulation layers 430 and 440 may be formed of a material selected from the group consisting of mica, polyimide, ceramic, silicon, polyurethane, glass, and polytetrafluoruethylene (PTFE). The first and second insulation layers 430 and 440 may be formed of a material, other than those set forth herein, without departing from the scope of the present invention.

FIG. 4B is a more detailed diagram of a section A shown in FIG. 4A. Referring to FIG. 4B, the first insulation layer 430 is interposed between the heating body 460 and the fusing roller portion 420. The first insulation layer 430 prevents a short circuit between the heating body 460 and the fusing roller portion 420. A thin insulation layer is inserted between the heating body 460 and the fusing roller portion 420 in order to prevent a short circuit between the heating body 460 and the fusing roller portion 420. A withstand voltage of the first insulation layer 430 may be equal to or less than 1 kV. In order to satisfy the requirement that the withstand voltage be equal to or less 1 kV, for example, in order to prevent a short circuit between the heating body 460 and the fusing roller portion 420, a mica sheet having a thickness of 0.1 mm can be used as the first insulation layer 430 of the fusing unit 360. Similarly, a mica sheet having a thickness of 0.1 mm can also be used as the second insulation layer 440. If the mica sheet having the thickness of 0.1 mm is damaged, two mica sheets 430*a*, 430*b* having a thickness of 0.1 mm may be used to prevent the fusing roller portion 420 and the heating body 460 from being short-circuited with each other. Similarly, two mica sheets 440*a*, 440*b* having a thickness of 0.1 mm may be used to prevent the tube-expansion adhesion unit 450 and the heating body 460 from being short-circuited with each other.

As the thickness of the first insulation layer 430 inserted between the fusing roller portion 420 and the heating body 460 increases, less heat generated by the heating body 460 is transferred to the fusing roller portion 420. Thus, if the thickness of the first insulation layer 430 is decreased, heat generated by the heating body 460 can be more effectively transferred to the fusing roller portion 420. The first insulation layer 430 may be formed of a material, other than those set forth herein without departing from the scope of the present invention.

Figure 5:
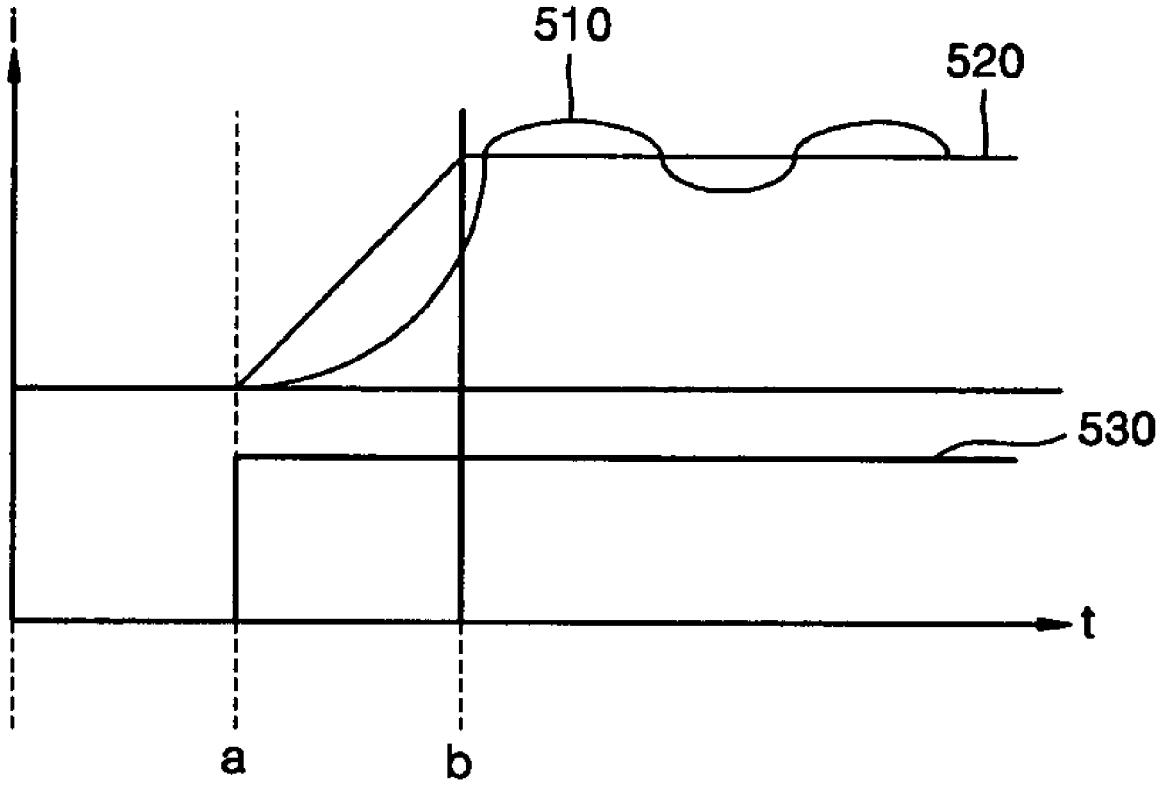
FIG. 5 shows a graph illustrating an induced current input to the fusing unit of the exemplary fusing apparatus of FIG. 3, a reference signal, and an ON signal used for controlling the generation of the induced current.

FIG. 5 shows a graph illustrating induced currents 510 and 520 provided to the fusing unit 360 and ON/OFF signal 530 generated by the ON/OFF signal generation unit 380. Referring to FIG. 5, the ON/OFF signal generation unit 380 generates an ON signal having a logic high level at a moment when the sensing unit 370 senses the temperature of the fusing roller unit 368 to be lower than a target temperature. The PWM signal generation unit 394 generates a PWM signal so that the amount of induced current input to the fusing unit 360 gradually increases in a section between a and b under the control of the soft starter 396. The induced current 520 is generated by the PWM signal. The amount of induced current 510 input to the fusing unit 360 is measured, and the difference between the induced currents 510 and 520 is calculated. Thereafter, the frequency of the PWM signal is controlled so that the difference between the induced currents 510 and 520 is compensated for. For example, if the induced current 510 is larger than the induced current 520, the frequency of the PWM signal is increased. Alternatively, when the induced current 510 is lower than the induced current 520, the frequency of the PWN signal is reduced.

Figure 6:
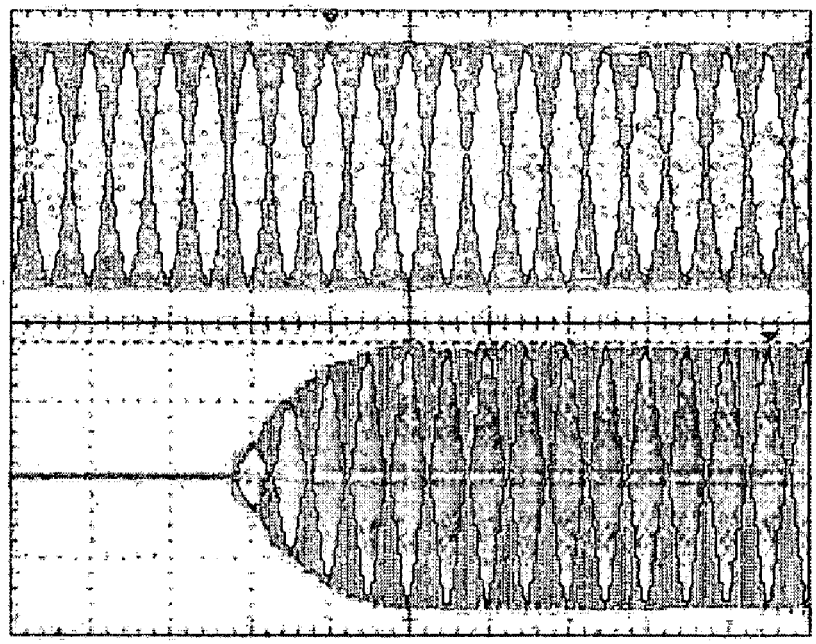
FIG. 6 depicts a diagram illustrating a voltage and current input to the fusing unit of the exemplary fusing apparatus of FIG. 3.

FIG. 6 depicts a diagram illustrating a current and voltage input to the fusing unit 360 of the exemplary fusing apparatus of FIG. 3. Referring to FIG. 6, when the fusing unit 360 is turned ON to increase its temperature, the amount of induced current input to the fusing unit 360 gradually increases to its maximum for a predetermined amount of time. In other words, the induced current input to the fusing unit 360 is controlled through a soft start.

Figure 7:
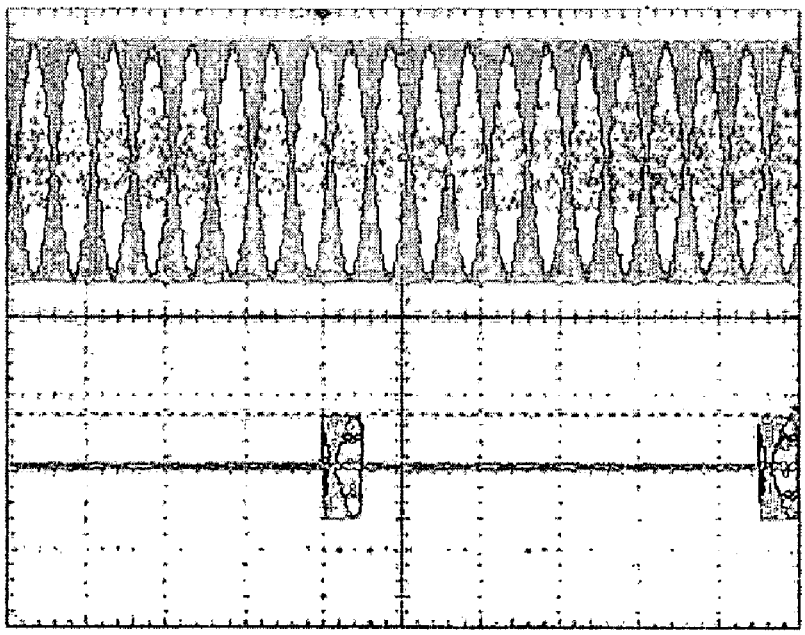
FIG. 7 depicts a diagram illustrating a voltage and a current input to the fusing unit of the exemplary fusing apparatus of FIG. 3 in the case of consecutively printing a plurality of images using the exemplary fusing apparatus of FIG. 3.

FIG. 7 depicts a diagram illustrating a current and voltage input to the fusing unit 360 of the exemplary fusing apparatus of FIG. 3 in the case of consecutively printing a plurality of images using the fusing apparatus of FIG. 3. Referring to FIG. 7, the amount of induced current input to the fusing unit 360 to increase the temperature of the fusing unit 360 gradually increases for a predetermined amount of time. Thus, not a maximum induced current but an optimum induced current is input to the fusing unit 360 so as to maintain the temperature of the fusing unit 360 at a predetermined level.

The fusing apparatus according to an aspect of the present invention comprises a thin insulation layer and thus can effectively transfer heat generated by a coil to a fusing roller unit and can quickly heat the fusing roller unit to a target temperature. In addition, it is possible to improve the flicker characteristics of the fusing apparatus according to the present invention by controlling the frequency of a PWM signal so that the amount of induced current input to a fusing unit gradually increases.

While the present invention has been particularly shown and described with reference to certain exemplary embodiments thereof, it will be understood by those of ordinary skill in the art that various changes in form and detail may be made therein without departing from the spirit and scope of the present invention as defined by the appended claims.

What is claimed is:

1. A fusing apparatus for fusing toner onto paper, comprising:
- a fusing unit which is resistance-heated or induction-heated by an induced current and fuses toner onto paper using heat;
- a sensing unit for sensing fusing unit temperature;
- an ON/OFF signal generation unit for generating an ON/OFF signal for turning the fusing unit ON or OFF according to the fusing unit temperature; and
- a pulse width modulation (PWM) signal generation unit for generating a PWM signal in response to the ON signal so that the amount of induced current input to the fusing unit gradually increases relative to a reference current.

2. The fusing apparatus of claim 1, wherein the fusing unit comprises:
- an alternating current (AC) generation unit for generating an AC current based on the PWM signal;
- an isolation unit for receiving the AC current and generating an induced current corresponding to the AC current; and
- a toner fusing unit which is resistance-heated or induction-heated by the induced current received from the isolation unit, thereby generating heat and fusing toner onto paper using the heat.

3. The fusing apparatus of claim 2, wherein the PWM signal generation unit comprises:
- a signal generator for generating a PWM signal having a predetermined frequency to generate the induced current provided to the fusing unit; and
- a soft starter which controls the frequency of the PWM signal so that the amount of the induced current provided to the fusing unit gradually increases relative to the reference current for a predetermined amount of time.

4. The fusing apparatus of claim 3, wherein the PWM signal generation unit further comprises a comparator for comparing the induced current to be provided to the fusing unit and the reference current, wherein the signal generator controls the frequency of the PWM signal according to the comparison determined by the comparator.

5. The fusing apparatus of claim 4, wherein the soft starter controls the frequency of the PWM signal via software.

6. The fusing apparatus of claim 4, wherein the soft starter controls the frequency of the PWM signal via hardware.

7. The fusing apparatus of claim 4, wherein the AC generation unit comprises a half-bridge inverter.

8. The fusing apparatus of claim 7, wherein the isolation unit comprises a transformer that electrically isolates the half-bridge inverter from the fusing unit.

9. The fusing apparatus of claim 4, wherein the fusing unit comprises:
- a heating element which is resistance-heated or induction-heated by the induced current; and
- a fusing roller portion for fusing toner onto paper using the heat generated by the heating element,
- wherein the heating element comprises:
- a heating body comprising an inductance and a resistance;
- a resonance capacitor forming a resonance circuit with the inductance; and
- an insulation layer for insulating the heating body from the fusing roller portion.

10. The fusing apparatus of claim 9, wherein the insulation layer comprises a withstand voltage of 1 kV.

11. The fusing apparatus of claim 9, wherein the heating element and the fusing roller portion are coupled such that they rotate together.

12. A method of reducing fusing apparatus flicker, the method
- comprising:
- sensing fusing unit temperature of a fusing unit within the fusing apparatus, the fusing unit being resistance-heated or induction-heated by an induced current;
- generating an ON/OFF signal for turning the fusing unit ON or OFF according to the fusing unit temperature; and
- generating a pulse width modulation (PWM) signal in response to the ON signal so that the induced current provided to the fusing unit gradually increases relative to a reference current.

13. The method of claim 12, comprising:
- generating an alternating current (AC) current via an AC generation unit based on the PWM signal;
- generating an induced current corresponding to the generated AC current via an isolation unit;
- heating a toner fusing unit which is resistance-heated or induction-heated by the induced current received from the isolation unit,
- wherein the generated heat causes toner to fuse onto paper.

14. The method of claim 13, comprising:

generating a PWM signal having a predetermined frequency to generate the induced current provided to the fusing unit; and controlling the frequency of the PWM signal with a soft starter so that the amount of the induced current provided to the fusing unit gradually increases relative to the reference current for a predetermined amount of time.

15. The method of claim 14, comprising:

comparing the induced current provided to the fusing unit with the reference current with a comparator, wherein the frequency of the PWM signal is determined as a result of the comparison of the induced current and reference current by the comparator.

16. A computer readable medium having stored thereon instructions for reducing fusing apparatus flicker, the instructions comprising:

a set of instructions for sensing fusing unit temperature of a fusing unit within the fusing apparatus, the fusing unit being resistance-heated or induction-heated by an induced current;

a set of instructions for generating an ON/OFF signal for turning the fusing unit ON or OFF according to the fusing unit temperature; and a set of instructions for generating a pulse width modulation (PWM) signal in response to the ON signal so that the induced current provided to the fusing unit gradually increases relative to a reference current.

17. The computer readable medium of claim 16, comprising:

a set of instructions for generating an alternating current (AC) current via an AC generation unit based on the PWM signal;

a set of instructions for generating an induced current corresponding to the generated AC current via an isolation unit;

a set of instructions for heating a toner fusing unit which is resistance-heated or induction-heated by the induced current received from the isolation unit, wherein the generated heat causes toner to fuse onto paper.

18. The computer readable medium of claim 17, comprising:

a set of instructions for generating a PWM signal having a predetermined frequency to generate the induced current provided to the fusing unit; and a set of instructions for controlling the frequency of the PWM signal with a soft starter so that the amount of the induced current provided to the fusing unit gradually increases relative to the reference current for a predetermined amount of time.

19. The computer readable medium of claim 18, comprising:

a set of instructions for comparing the induced current provided to the fusing unit with the reference current with a comparator, wherein the frequency of the PWM signal is determined as a result of the comparison of the induced current and reference current by the comparator.

* * * * *

UNITED STATES PATENT AND TRADEMARK OFFICE

CERTIFICATE OF CORRECTION

PATENT NO. : 7,598,476 B2
APPLICATION NO. : 11/299631
DATED : October 6, 2009
INVENTOR(S) : Chae et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 966 days.

Signed and Sealed this

Twenty-eighth Day of September, 2010

David J. Kappos

David J. Kappos
*Director of the United States Patent and Trademark Office*